United States Patent [19]

Kivipelto

[11] Patent Number: 5,016,349

[45] Date of Patent: May 21, 1991

[54] METHOD FOR MANUFACTURE OR REPAIR OF A GLOBE VALVE

[75] Inventor: Pekka J. Kivipelto, Helsinki, Finland

[73] Assignee: Neles Oy, Helsinki, Finland

[21] Appl. No.: 372,329

[22] Filed: Jun. 28, 1989

[30] Foreign Application Priority Data

Jun. 29, 1988 [FI] Finland ..... 883103

[51] Int. Cl.[5] ..... B21D 53/00

[52] U.S. Cl. ..... 29/890.121; 29/402.02; 29/463; 29/890.125; 29/890.13; 29/890.131

[58] Field of Search ..... 29/157.1 R, 402.02, 29/463, 890.121, 890.125, 890.13, 890.131, 890.124; 228/184, 214; 51/27; 251/315, 314, 309, 304

[56] References Cited

U.S. PATENT DOCUMENTS

| | | | |
|---|---|---|---|
| 1,806,918 | 5/1931 | Riggs | 51/27 |
| 3,161,204 | 12/1964 | Roy, Sr. | 29/157.1 R |
| 3,192,948 | 7/1965 | Anderson et al. | 29/157.1 R |
| 3,264,718 | 8/1966 | Paul, Jr. | 29/157.1 R |
| 3,286,981 | 11/1966 | Brice | 29/157.1 R |
| 4,164,343 | 8/1979 | Graebner | 29/157.1 R |
| 4,235,003 | 11/1980 | Gachot | 29/157.1 R |
| 4,580,763 | 4/1986 | Velan | 251/315 |

FOREIGN PATENT DOCUMENTS

| | | | |
|---|---|---|---|
| 1148765 | 4/1969 | United Kingdom | 251/315 |
| 1581499 | 12/1980 | United Kingdom | 29/157.1 R |

*Primary Examiner*—P. W. Echols
*Assistant Examiner*—Irene Cuda
*Attorney, Agent, or Firm*—Cushman, Darby & Cushman

[57] ABSTRACT

Method for the manufacture or repair of a globe valve. The valve housing (1) is assembled by welding out of two or more parts around a closing member (4) shaped as a part of the face of a globe and provided with a flow opening (3), and the shaft (5) of rotation of the closing member is attached to the closing member. Before the shaft (5) of rotation of the closing member is installed in its place, the closing member (4) is turned in the housing (1) so that the point (8) of fastening of the shaft of rotation becomes positioned facing the first flow duct (6) of the housing, and the shaft of rotation is inserted into the closing member through this flow duct (6) and attached to the closing member (b 4). The end of the closing member (4) placed facing away from the shaft (5) of rotation is pressed against the sealing face (7') of the second flow duct (6') of the housing, and this sealing face (7') is ground by means of the end of the closing member, or the end placed at the side of the shaft of rotation is pulled against the other sealing face, and this sealing face is ground by means of the end placed at the side of the shaft of rotation.

5 Claims, 1 Drawing Sheet

METHOD FOR MANUFACTURE OR REPAIR OF A GLOBE VALVE

FIELD OF THE INVENTION

The present invention concerns a method for the manufacture or repair of a globe or a ball valve, in which the method the valve housing is assembled by welding out of two or more parts around a closing member shaped as a part of the face of a globe and provided with a flow opening and the shaft for rotation of the closing member is attached to the closing member, before the shaft of the closing member is installed in its place, the closing member is turned in the housing so that the point of fastening of the shaft of rotation becomes positioned facing the first flow duct of the housing and the shaft is inserted into the closing member through this flow duct and attached to the closing member.

What is provided is a valve which consists of a single-part housing made by welding and provided with a through flow duct, of a spherical closing member fitted in the housing rotatably and provided with a flow duct and connected detachably to a rotation shaft passing to outside the housing, and of a dismountable axial bearing of the shaft, with the bearing preventing pushing of the shaft of rotation out of the housing by the effect of the internal pressure in the housing.

A welded one-part valve housing is easy to manufacture, the requirement of raw-material is low, and the result is a low-weight, compact and tight housing. The construction, however, has its drawbacks, because therein the possibility of simple repair of the valve is lost. Small valves are usually disposable, whereas large pipeline valves, e.g. for natural-gas transfer pipelines, can be repaired under factory conditions by means of special operations, e.g. by opening the joints of the assembly welding and by again welding the housing together after the repair.

DESCRIPTION OF THE PRIOR ART

Welded valves are descrIbed, e.g., in the U.S. Pat. No. 4,235,003 and in the published GB Pat. Appl. No. 2,062,177.

So far, the welded one-part globe or ball valves have also been valves provided with soft seals. A soft seal has permitted the manufacture of well sealed valves, for a resilient seal has equalized any deformations and shifts produced by the welding-together, which deteriorate the sealing.

A soft seal restricts the resistance to temperature and pressure. Contaminated or crystallizable media damage the seals, and repeated open-close operations result in rapid wear and in leakage-through.

Due to the above reasons, in many applications a valve provided with flange joint and metal seals is used even though the cost of this construction is higher.

SUMMARY OF THE INVENTION

The object of the present invention is to provide a method by means of which it is possible to manufacture a tight-closing globe valve with metal seals housing of which is assembled by welding into one part. The method of the invention is characterized in that the end of the closing member placed facing away from the shaft of rotation is pressed against the sealing face of the second flow duct of the housing, and this sealing face is ground by means of the end of the closing member, or the end placed at the side of the shaft of rotation is pulled against the other sealing face, and this sealing face is ground by means of the end placed at the side of the shaft of rotation.

By means of the method in accordance with the invention it is possible to ensure that any deformations produced at the sealing faces of the flow openings in connection with the welding-together of the parts are straightened.

BRIEF DESCRIPTION OF THE DRAWING

The invention and its details will be described in more detail in the following with reference to the accompanying drawings, wherein.

DETAILED DESCRIPTION OF THE INVENTION

Figure 1:
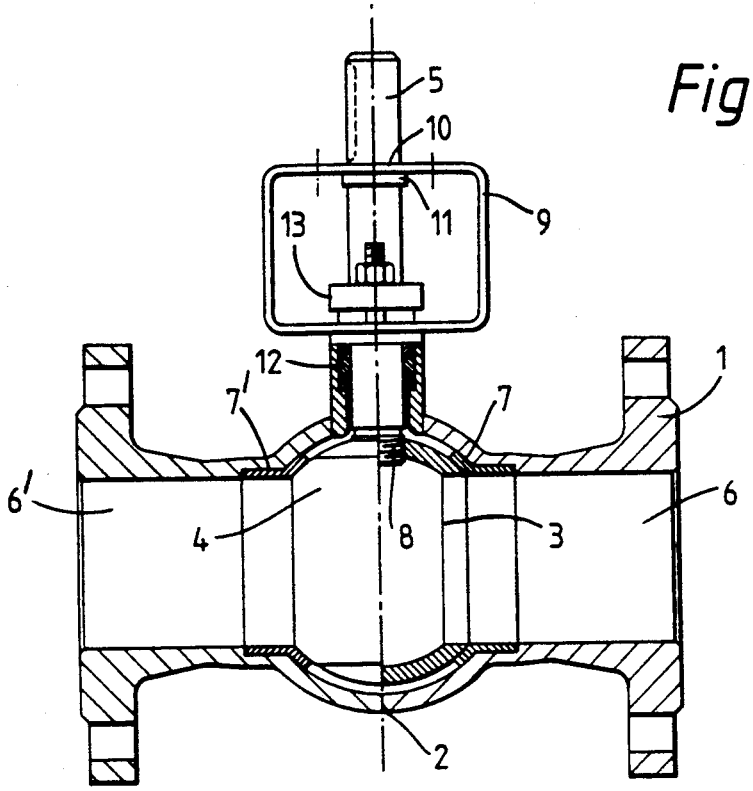
FIG. 1 shows a valve manufactured by means of the method of the invention partly in section in the plane of the flow duct and the shaft of rotation of the closing member and FIG. 2 shows the same valve during the stage of grinding of the method of the invention.

The valve has a construction in itself known. The housing 1 of the valve consists of two halves, which have been welded together along the joint 2 placed in the plane perpendicular to the direction of flow. The closing member consists of a globe 4 provided with a flow opening 3 and attached to a shaft 5 of rotation. Between the spherical face and the flow ducts 6 and 6' in the housing there are metallic closing seals 7 and 7'.

The shaft 5 of rotation is attached to the globe 4 by means of a readily detachable joint 8 that transfers a torque, e.g. a multi-slot joint. The shaft 5 is mounted on the fastening bracket 9 by means of an axial bearing 10 that can be disassembled. A lock ring 11 prevents the shaft from being pushed outwards by the effect of pressure. The fastening bracket 9 is intended for fastening of the actuating member, and at the same time it forms a counter-face for the axial bearing. Between the bushing 14 attached to the housing 1 and the shaft 5 of rotation, there is a shaft seal 12, e.g. a gland packing, which can be tightened by means of an adapter sleeve 13.

In FIG. 1, the valve is shown in the opened position, whereat the flow opening 3 passing through the closing member is parallel to the flow ducts 6 and 6'. When the shaft 5 of rotation is rotated by 90°, the flow opening in the closing member is turned to the transverse position, and the valve is closed.

By means of the method of the invention, the manufacture of the valve takes place as follows. The seals 7 and 7' are placed in their positions, each of them in its own housing half. The housing halves are placed around the globe 4 and welded together along the joint 2. At the same time, the bushing 14 is welded into its position.

Figure 2:
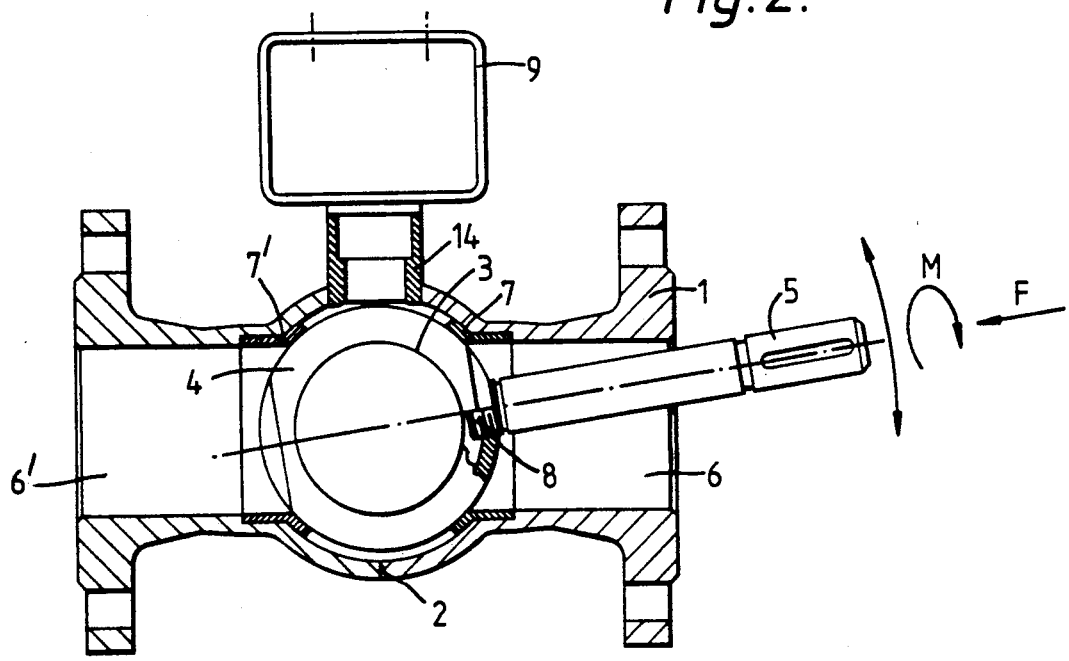

After welding-together of the housings, the globe 4 is turned into the position shown in FIG. 2. The shaft 5 of rotation is inserted into its point of fastening through one flow duct 6 in the housing and attached to the globe. It is possible to turn the globe, because there must be a play between the closing member and the seals in a globe valve with metal seals. Otherwise, the globe will get stuck and be deformed between the seals when a hot medium raises the temperature of the globe to a level higher than the temperature of the housing. In such a case, the movement of thermal expansion of the globe is larger than the expansions of the housing and of the closing seals resting on the housing.

Grinding paste is spread onto the intact bottom face of the globe, placed facing away from the shaft 5 of rotation, through the opposite flow duct 6', and the lapping of the seal 7' can be carried out by means of the shaft 5 of rotation by rotating the shaft and by pivoting it in a plane and by at the same time pressing the globe against the seal 7'. Thereby the spherical face grinds off any inaccuracies of shape produced during welding out of the counter-face of the seal. Any extra grinding paste is washed off.

The shaft of rotation is detached from the globe, and thereinafter the globe is turned so that its bottom face is placed facing the other seal 7, and the shaft of rotation is inserted into its position correspondingly through the other flow duct 6'. In this way the other seal 7 is ground in a way corresponding to the grinding of the first seal 7', whereupon the shaft of rotation is detached from the globe.

In an arrangement of pulling, the shaft 5 described is not used, but a special shaft produced for this purpose, which may, e.g., be locked into the globe 4 for the purpose of pulling through the flow opening 3 and through the hole in the bushing 14 before the grinding is started. The grinding is carried out in a way corresponding to the pressing of the globe against the seal.

The grinding of the seals 7 and 7' can be carried out immediately after welding if it is suspected that the shape of the seal has been altered, or after operation if leakage-through is noticed.

After the lapping operation, the globe is turned to the operating position and the shaft, the gland packing, and the axial bearing are installed in their positions.

The invention is not confined to the embodiment described above alone, but it may show variation in different ways within the scope of the patent claims. The method can be employed in different types of globe valves provided with a metallic or plastic closing seal, provided that the shaft of rotation can be detached from, and attached to, the globe after the welding-together of the housing. The fixing of the shaft must, however, be such that the shaft cannot be pushed out of the housing when the housing is under pressure. Preferably, the axial bearing is placed outside the housing, it is clearly visible, and it is not affected by the medium in the pipe system.

It is required from the closing member that its outer face is spherical outside the area defined by the flow opening, in particular at the side opposite to the point of connection of the shaft of rotation.

What is claimed is:

1. In a method of manufacturing or repair of a ball valve of the type having a housing including two parts including the step of welding together the two parts to form the housing around a closing member in the form of a ball having a through bore with a rotation shaft attachable to said ball at a fastening portion on said ball, the housing having a pair of flow openings each including a sealing face and the step of, prior to attachment of the shaft to the ball, turning the ball in the housing to bring the fastening portion to a position facing one of the flow openings of the housing and the step of inserting the shaft through said one of the flow openings so that the shaft engages the ball at the fastening portion and the opposite side of the ball faces away from the fastening portion, the improvement comprising the steps of pressing the opposite side of the ball against the sealing face of the other of said flow openings, grinding the sealing face of the other of said flow openings with the opposite side of the ball.

2. The invention as claimed in claim 7 wherein the ball has a face around the fastening portion and the method includes the step of pressing the face of ball around the fastening portion against the sealing face of the said one of the flow openings and grinding the sealing face of the said one of the flow openings therewith.

3. The invention as claimed in claim 1 or 2 wherein the ball has a center of rotation and said shaft has an axis that passes through said center of rotation when said shaft is attached to said fastening portion and including the step of rotating said shaft about said axis to effect said grinding.

4. The invention as claimed in claim 1 or 2 wherein said shaft has a longitudinal axis and including the step of rotating said shaft about said longitudinal axis after attachment to said ball to effect said grinding.

5. The invention as claimed in claim 1 or 2 including the step of disposing a grinding paste between the ball and a said sealing face to be ground.

* * * * *